US010504713B2

(12) United States Patent
Chen et al.

(10) Patent No.: US 10,504,713 B2
(45) Date of Patent: Dec. 10, 2019

(54) FREQUENCY SCAN LINEAR ION TRAP MASS SPECTROMETRY

(71) Applicant: Academia Sinica, Taipei (TW)

(72) Inventors: Chung-Hsuan Chen, Taipei (TW); I-Chung Lu, Taichung (TW); Ming-Lee Chu, Xizhi (TW)

(73) Assignee: Academia Sinica, Taipei (TW)

( * ) Notice: Subject to any disclaimer, the term of this patent is extended or adjusted under 35 U.S.C. 154(b) by 0 days.

(21) Appl. No.: 15/046,387

(22) Filed: Feb. 17, 2016

(65) Prior Publication Data

US 2016/0163529 A1 Jun. 9, 2016

Related U.S. Application Data

(63) Continuation-in-part of application No. 13/534,449, filed on Jun. 27, 2012, now abandoned.

(60) Provisional application No. 61/502,140, filed on Jun. 28, 2011.

(51) Int. Cl.

| | |
|---|---|
| ***H01J 49/42*** | (2006.01) |
| ***H01J 49/16*** | (2006.01) |
| ***H01J 49/02*** | (2006.01) |

(52) U.S. Cl.

CPC ..... *H01J 49/429* (2013.01); *H01J 49/161* (2013.01); *H01J 49/022* (2013.01); *H01J 49/164* (2013.01)

(58) Field of Classification Search

None

See application file for complete search history.

(56) References Cited

U.S. PATENT DOCUMENTS

| | | | | |
|---|---|---|---|---|
| 9,006,650 | B2 * | 4/2015 | Chen | G01N 33/4833 250/281 |
| 2003/0122070 | A1 * | 7/2003 | Chang | H01J 49/0404 250/292 |
| 2005/0279932 | A1 * | 12/2005 | Wang | H01J 49/424 250/290 |
| 2006/0016981 | A1 * | 1/2006 | Park | H01J 49/063 250/288 |
| 2006/0038123 | A1 * | 2/2006 | Quarmby | H01J 49/427 250/292 |
| 2009/0189069 | A1 * | 7/2009 | Chen | H01J 49/4265 250/282 |
| 2010/0072362 | A1 * | 3/2010 | Giles | H01J 49/4295 250/287 |
| 2010/0237237 | A1 * | 9/2010 | Green | H01J 49/004 250/283 |

OTHER PUBLICATIONS

Lu et al., "Frequency-scanning MALDI linear ion trap mass spectrometer for large biomolecular ion detection" Anal Chem., Nov. 2011 (Epub Oct. 3, 2011).*

* cited by examiner

*Primary Examiner* — James Choi
(74) *Attorney, Agent, or Firm* — Eckman Law Group

(57) ABSTRACT

An ion trap mass spectrometer and methods for obtaining a mass spectrum of ions by scanning an RF frequency applied to the linear ion trap for mass selective ejection of the ions by using two power amplifiers to apply opposite phases of the RF to x and y electrodes.

12 Claims, 12 Drawing Sheets

FREQUENCY SCAN LINEAR ION TRAP MASS SPECTROMETRY

BACKGROUND OF THE INVENTION

Mass spectrometry is a useful method for identifying a molecule or ion by its mass-to-charge ratio (m/z). Mass spectrometry has been applied to the study of proteins, organelles, and cells to characterize molecular weight, products of protein digestion, proteomic analysis, metabolomics, and peptide sequencing, among other things. A limitation of mass spectrometry is the difficulty in rapidly measuring biomolecules or macromolecules of high mass-to-charge ratio.

Recent progress in mass spectrometry for biomolecules includes electrospray ionization (ESI) and matrix-assisted laser desorption ionization (MALDI). An ESI source can extend the observable mass range by creating ions from large molecules without fragmenting them. However, ESI may produce a number of charge states or multiply-charged ions that often leads to unnecessarily complex mass spectra. Moreover, the signal of a particular biomolecule may be distributed over many peaks in the mass spectrum which reduces the sensitivity of detection. In general, ESI is not suitable for samples having large numbers of compounds. In some cases, a pre-separation device such as HPLC can be used with an ESI source when the sample contains many compounds. For ion trap mass spectrometry, the multiply-charged ions produced by ESI can cause undesirable space-charge effects inside the ion trap. In contrast, MALDI produces singly-charged ions and can reduce or eliminate the disadvantages of ESI. MALDI is convenient for sample preparation and obtaining the entire mass profile of a complex sample.

For proteomics a mass spectrometer should be able to detect a broad mass range. A high linear dynamic voltage range is essential to this goal. Ion trapping methods such as two-dimensional linear ion traps (LIT) have been useful for proteomics in general by mass-selective ejection of ions from the trap. An advantage of the linear ion trap is that it has a large capacity for ions. This advantage may reduce the space charge effect during mass spectral analysis. However, the mass-to-charge ratio detected by voltage scanning linear ion trap mass spectrometry is limited to about 6000, which is below the mass for most proteins.

There is a continuing need for methods for detecting proteins and biomolecules using a mass spectrometer. There is also a need for an apparatus and arrangement for a mass spectrometer that can detect biomolecular ions over a wide mass range. There is a further need for a mass spectrometer apparatus and methods capable of detecting biomolecules rapidly at high resolution for studies in proteomics.

BRIEF SUMMARY OF THE INVENTION

This invention relates to the fields of mass spectrometry and proteomic and biomolecule research. In particular, this application relates to methods for high speed proteomics and detecting large biomolecular ions in mass spectrometry. More particularly, this application relates to linear ion trap devices and frequency scan methods for mass spectrometry for detecting macromolecules and biomolecules.

Embodiments of this invention can provide methods for detecting proteins and biomolecules using a mass spectrometer. This disclosure also provides an apparatus and arrangement for a mass spectrometer that can detect large biomolecular ions. Embodiments of this disclosure may further provide a mass spectrometer apparatus and methods capable of detecting biomolecules rapidly at high resolution for studies in proteomics.

This invention provides novel ion trapping, ejection and detection methods for mass spectrometry using a two-dimensional linear ion trap that are useful for proteomics studies. In this invention, frequency-scanning linear ion trap mass spectrometry is demonstrated with matrix-assisted desorption/ionization (MALDI) that can be used to measure very high mass-to-charge ratio (m/z) ions. A MALDI-LIT mass spectrometer of this invention can analyze mass to charge ratios of up to 150,000 and greater.

In some aspects, this disclosure provides methods for obtaining a mass spectrum of ions comprising providing a two dimensional linear ion trap comprising x and y electrodes, scanning an RF frequency applied to the linear ion trap for mass selective ejection of the ions by using two power amplifiers to apply opposite phases of the RF to the x and y electrodes. The x and y electrodes can be two x electrode rods and two y electrode rods in a quadrupole arrangement. Each power amplifier may be tuned with a capacitance to provide the same amplitude of RF and a fixed degree of phase difference of the RF to the x and y electrodes.

In some embodiments, the mass selective ejection of the ions is generated by mass selective instability with or without resonance excitation by boundary ejection. The ejection of the ions can be axial along the z axis, or perpendicular through a slot in an x electrode. The ejection of the ions may be through a slot in an x electrode.

In certain aspects, the linear ion trap may contain a buffer gas of helium, or other rare gas or mixture of gases, at a pressure of from 1 to 500 mTorr.

The ions can be generated by MALDI, electrospray ionization, laser ionization, thermospray ionization, thermal ionization, electron ionization, chemical ionization, inductively coupled plasma ionization, glow discharge ionization, field desorption ionization, fast atom bombardment ionization, spark ionization, or ion attachment ionization.

In further embodiments, this invention provides methods for obtaining a mass spectrum of ions comprising trapping the ions in a linear ion trap comprising two x electrode rods and two y electrode rods in a quadrupole arrangement, and two end-cap electrodes, providing a scanning frequency of RF, and amplifying the scanning frequency of RF using two power amplifiers to apply opposite phases of the RF to the x and y electrodes with the same RF amplitude.

In some aspects, this disclosure includes a linear ion trap mass spectrometer for obtaining a mass spectrum of ions, the linear ion trap mass spectrometer comprising a two dimensional linear ion trap for trapping and ejecting the ions comprising two slotted x electrode rods and two y electrode rods in a quadrupole arrangement, an inductance forming an LC circuit with the capacitance of the ion trap, a first end cap plate perpendicular to the electrode rods at a first end of the linear ion trap and a second end cap plate perpendicular to the electrode rods at a second end of the linear ion trap, wherein the first end cap defines an opening for a sample probe, and wherein the second end cap defines an opening for a laser beam, a plastic cover isolating the linear ion trap so that the atmosphere in the trap can be controlled with a pump, a controller for providing a scanning ion ejecting RF frequency, a dynode, and a charge detector.

In certain embodiments, the electrode rods may be 54 mm long and 9 mm in diameter. The slots in the x electrode rods may be 0.4 mm in width and 34 mm in length. The half distance between the x electrode rods can be 9.25 mm. The half distance between the y electrode rods can be 8.5 mm. The end plates can be spaced apart by 1 to 10 mm from the ends of the electrode rods.

In certain aspects, the linear ion trap may contain a buffer gas. The buffer gas can be helium, or other rare gas or mixture of gases, at a pressure of from 1 to 500 mTorr.

In the following description, reference is made to the accompanying drawings that form a part hereof, and in which is shown by way of illustration specific embodiments which may be practiced. These embodiments are described in detail to enable those skilled in the art to practice the invention, and it is to be understood that other embodiments may be utilized and that structural, logical and electrical changes may be made without departing from the scope of the present invention. The following description of example embodiments is, therefore, not to be taken in a limited sense, and the scope of the present invention is defined by the appended claims.

DETAILED DESCRIPTION OF THE INVENTION

Embodiments of this invention provide novel methods in mass spectrometry for the study of proteins, organelles, and cells to characterize molecular weight, products of protein digestion, proteomic analysis, metabolomics, and peptide sequencing, among other things.

This disclosure provides novel ion trapping, ejection and detection methods for mass spectrometry using a two-dimensional linear ion trap that are useful for proteomics studies.

In this invention, frequency-scanning linear ion trap mass spectrometry is demonstrated with matrix-assisted desorption/ionization (MALDI) that can be used to measure very high mass-to-charge ratio (m/z) ions. A MALDI-LIT mass spectrometer of this invention can analyze mass to charge ratios of up to 150,000 and greater.

In brief, mass-selective ejection of ions from the trap can be done by frequency-scanning a resonant RLC circuit of the mass spectrometer in which the ion trap is a capacitance. The frequency sweep can be made to correspond to a range of mass to charge ratios for the detected ions.

In this invention, the mass spectra of large biomolecular ions produced by MALDI are obtained by frequency scanning methods using a linear ion trap as a mass analyzer. The methods and devices of this disclosure can extend the mass-to-charge ratio detection limit to 150,000 and greater.

The maximum range of mass-to-charge ratio in a linear ion trap can be estimated by the following equation:

$$\frac{m}{z} = \frac{4V_{0\to p}e}{q_x r_0^2 \omega^2} \qquad \text{Equaiton 1}$$

where $V_{0\to p}$ is the zero-to-peak amplitude of the RF potential, $r_0$ is the radius of the inscribed circle to the rod array, $\omega$ is the radial frequency of the RF potential, and $q_x$ is the trapping parameter.

In conventional ion trap mass spectrometry, the amplitude of RF is scanned for mass analysis. The RF frequency is usually fixed at about 1 MHz and generated by a resonance RLC electronic circuit. The maximum mass-to-charge ratio achieved is typically less than 6000 depending on the radius of the ion trap and the highest voltage the electronic circuit can withstand. To increase the mass-to-charge ratio following Equation 1, the resonance frequency can be reduced by increasing the capacitance and inductance of the RLC circuit. Nevertheless, the voltage capability of the circuit is a limitation. Moreover, the range of mass-to-charge ratio is still limited at a single fixed RF frequency if the voltage scan detection process is employed.

This disclosure provides methods and devices to measure a broad range of mass-to-charge ratios, as well as very high mass-to-charge ratios by frequency-scanning mass spectrometry.

Figure 1:
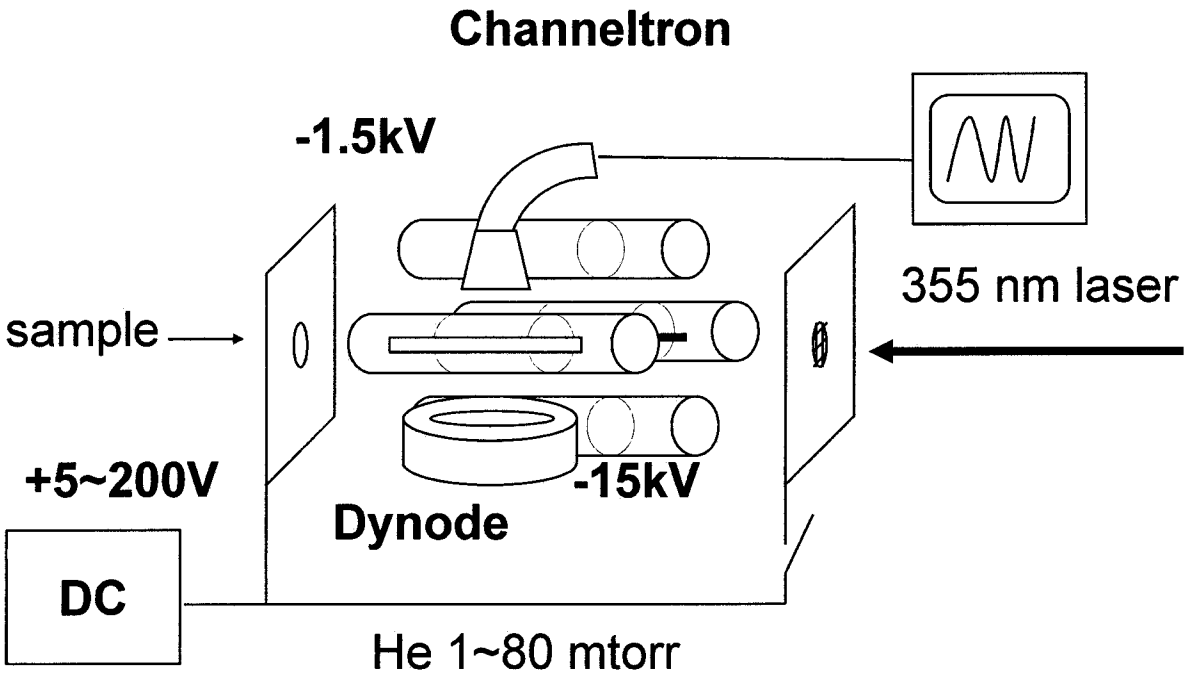
FIG. 1 shows an embodiment of a linear ion trap for frequency scan mass spectrometry.

As shown in FIG. 1, in certain embodiments, a linear ion trap is employed having x and y rods that were machined as cylindrical structures in stainless steel. Each rod is designed as 54 mm long and 9 mm diameter. Two pairs of electrodes and two planes of endcaps, 50 mm×50 mm, were used to construct the linear ion trap. Along the center section of the x electrode rods, a slot of 0.4 mm width and 34 mm length is cut for ion ejection. Two distinct distances between electrodes are designed in order to compensate destructive field effect from presence of slots. The half-distance between x pair of electrode ($r_{x0}$) is 9.25 mm, and the half-distance between y pair of electrode ($r_{y0}$) is 8.5 mm. To confine ions in the z axis direction, which is parallel to the elongated x and y electrodes, the endcaps are placed 1-10 mm from the end of electrodes. There is a 5 mm diameter hole placed in the center of the endcap plate. One of the holes, backward, is the inlet of sample probe, and another one is provided for passage of a laser beam. All components are mounted on a set of ceramic base.

The ejection of the ions can be axial along the z axis, or perpendicular through a slot in an x electrode.

In operation, the laser beam is focused on the sample-probe tip via the opposite endcap using an optical system. MALDI ions are generated inside the ion trap and are picked up by the RF field in the trapping process. To catch heavy ions in an ion trap, a high pressure of a buffer gas is used. More than 20 mTorr of helium leaks directly into the trap continuously to reduce kinetic energy of the MALDI generated ions. The trap is isolated by a plastic cover with a slit on the detector side, so that the vacuum of the main chamber can be maintained around $5\times10^{-5}$ Torr by a Varian turbo pump, for example, TURBO-V701 NAVIGATOR PUMP. After several laser shots, trapped ions are ejected by scanning the RF frequency downward linearly. Mass spectra are then generated by mass selective instability without resonance excitation by boundary ejection. The detection system consists of a conversion dynode held at −15 kV and a channeltron electron multiplier, for example DeTech XP-2217. After frequency scanning, ejected ions pass through the slit on the x electrode to the detector, and the detection system is arranged on only a single side of the linear ion trap. The output current is recorded by a digital storage oscilloscope, for example LeCory WaveRunner 64Xi, without any pre-amplification.

In the frequency scanning methods disclosed herein, two oppositely phased RFs are required to be applied to the x and y rods of the (2D) linear ion trap, respectively. The differences between the amplitudes and the phases of the two oppositely phased RFs applied to the x and y rods should be minimized and maintained stable to balance the 2D trap.

Figure 2:
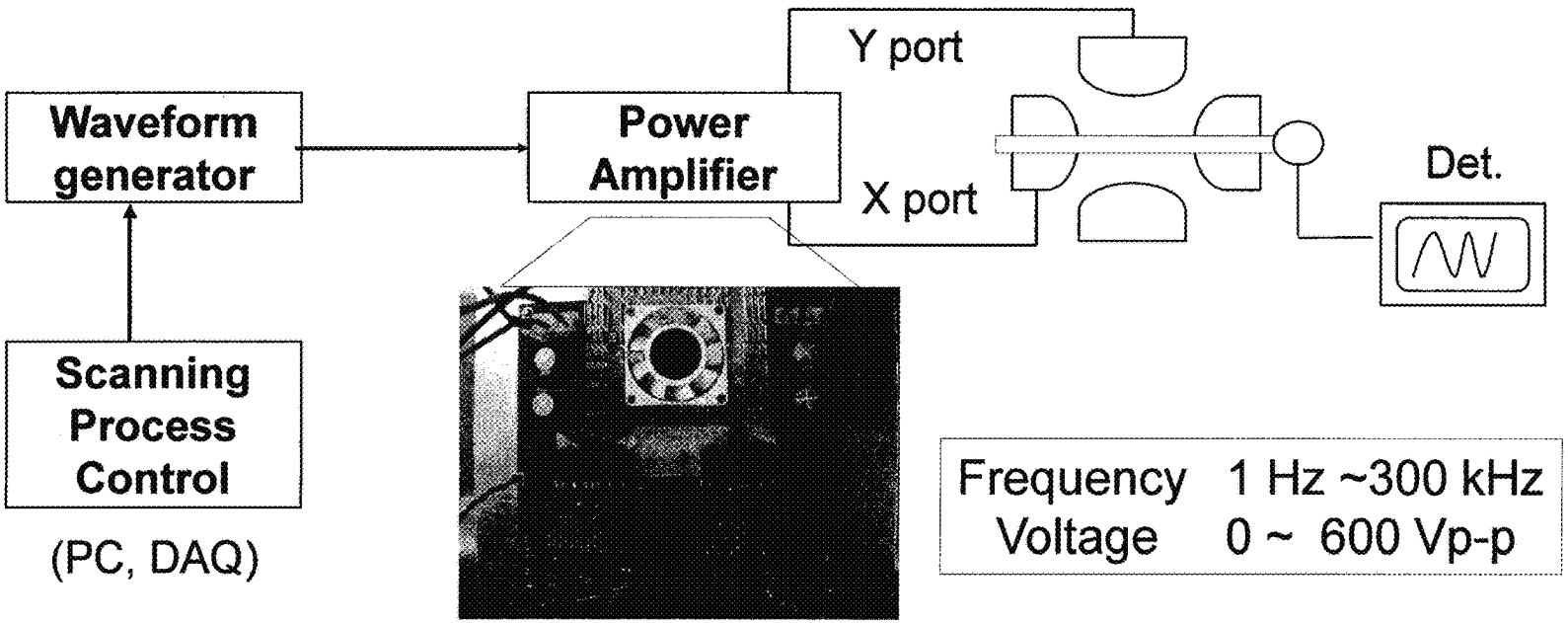
FIG. 2 shows a diagram of a frequency-scanning process with a linear ion trap using two high voltage MOSFET operational amplifiers. The output voltages of the power amplifiers can reach ±450 V. The power amplifiers produce stable amplitude of RF in the region below 300 kHz.

As shown in FIG. 2, in some embodiments of this invention, a frequency-scanning process can be performed on a linear ion trap by using two high voltage MOSFET operational amplifiers, for example APEX MICROTECHNOLOGY model PA94, are used as sine-wave power amplifiers. In order to balance or match the output voltage of the two amplifiers, two small capacitances are attached to the circuit for fine tuning. The output voltages of the power amplifiers can reach ±450 V. The power amplifiers are driven by two DC power supplies, for example Matsusada Precision Inc. Model S30-0.6N and S30-0.6P, which produce stable amplitude of RF in the region below 300 kHz. The DC power supplies are controlled by a PC and a DAQ converter, for example NI-USB-6221.

In some embodiments, an apparatus of this invention can employ an ion trap comprised of quadrupole rods, such as four rods, which can be made of stainless steel and machined with a cylindrical structure. Each rod can be designed to be 54 mm long with a 9 mm diameter. Along the center section of the x electrode, a slot of 0.4 mm width and 50 mm length can be cut for ion ejection. Two pairs of electrodes and two plates for the end caps (25 mm×25 mm) can be used to construct the linear ion trap. Two specific distances between the electrodes can be designed to compensate for the destructive field effect from the presence of slots. The half distances between the x pair of electrodes ($r_x$) and y pair of electrodes ($r_y$) can be 9.25 and 8.5 mm, respectively. To confine ions in the z axial direction, a pair of end caps can be set 5 mm from the end of the electrodes and an 80 V dc voltage can be applied to produce the axial trapping field. A 5 mm diameter hole can be placed in the center of the end-cap plate. One of the holes (backward) can be the inlet of the sample probe, and another one can be provided for passage of the laser beam. All of these components, including four quadrupole rods and two end caps, can be mounted on a set of ceramic holders.

The requirements of vacuum for an ion trap mass analyzer can be less demanding than those of other kinds of mass spectrometers, such as time-of-flight (TOF) and ion cyclotron resonance (ICR). To provide more collisions to reduce the kinetic energy of the MALDI ions, the linear ion trap can be isolated by an insulator and maintained at 1-80 mTorr, which can be somewhat higher than the pressure of a conventional ion trap. A slit can be placed on the insulator for detecting the ejected ions. Since the leakage of buffer gas from the slit might lead to high pressure discharge to damage the channeltron detector, the main chamber can be maintained about $5\times10^{-5}$ Torr using a turbopump (e.g., Turbo-V701 Navigator pump) to keep the vacuum below the region of possible discharge during the detection of the ejected ions.

Ions can be generated inside the ion trap by MALDI. The ions can be subsequently trapped by the RF field. The laser beam can be focused to a spot about 0.1 mm in diameter on the tip of the sample probe. Samples can be mixed with a matrix and dripped onto a stainless steel plate. The fluence of each laser pulse can be 1-3 mJ/mm$^2$. To catch heavy ions in an ion trap, a buffer gas can be required. Helium gas can be leaked directly into the trap continuously. More than 20 mTorr of He can be used in some embodiments to efficiently reduce the kinetic energy of the ions.

In some embodiments, specific waveforms can be used for two purposes: trapping ions and the subsequent ejection. The frequency scan can be used to cover a very broad mass range. It may cover a very high m/z by reducing the RF. Two opposite phases of RF can be applied to the rod pairs. These two RF voltages must be 180° out of phase and symmetric to the x and y rods. Not only the amplitude but also the phases between two pairs of the rods need to be well balanced. It can be more difficult to maintain these parameters balanced in a linear ion trap (2D) than those in a 3D ion trap. In conventional ion traps, the RF waveform may be amplified by a set of RCL circuits after signal generation. However, the RCL circuit is not suitable as an amplifier for frequency scan, since its resonance frequency is only in a narrow region. The amplitude decreases dramatically if the frequency shifts from the resonance point.

In some embodiments of this invention, a high voltage (900 Vpp) was used and a MOSFET operational amplifier (APEX Microtechnology, model PA94) was used as a sine-wave power amplifier. External compensation with this operation amplifier can provide flexibility in choosing the bandwidth and slew rate. The RF can be swept without altering gain so that a frequency scan in fixed amplitude can be performed. Since the performance can have a minor difference in each operational amplifier, a couple of adjustable capacitances can be attached to the circuit for fine-tuning. The gain of this amplifier can be very sensitive to the capacitance on the electronic circuit. To maximize trapping efficiency and resolution, two sets of aligning capacitances (<1 pF) can be employed to balance the amplitude of the RF system. The output voltage could reach ±450 V driven by two dc power supplies (Matsusada Precision Inc. models S30-0.6N and S30-0.6P), which can produce stable amplitude of the RF in the region below 300 kHz. The dc power supplies can be controlled by a PC and a DAQ converter (NIUSB-6221). The operational amplifier can operate with negative or positive feedback by different circuit arrangements to produce inverting or non-inverting output after amplification. Two opposite phases of the RF can be successfully generated, and subsequently provided to the x and y rods, respectively, to achieve frequency-scanning capability.

The rod with a slot can be moved out 0.75 mm from the center as compared to the regular position, so that this arrangement can compensate for destructive field effects from the slot. The detector system can consist of a conversion dynode, which can be held at −15 to −30 kV for positive ions, and a channeltron electron multiplier (De Tech XP-2217). The gain of the channeltron can be measured as ~$2\times10^7$. The oscilloscope can be triggered by the start of the sweep, and then the signal can be recorded as a function of time. A mass spectrum may then be obtained after conversion of the time scale to the scale of m/z.

A matrix solution can be employed in MALDI sample preparation, which can be 0.1 M sinapinic acid (Sigma) in 50% water/50% acetonitrile (v/v). Analytes can be dissolved in 50% acetonitrile with a concentration of 0.1 pmol/μL. MALDI samples can be prepared by mixing the analyte and matrix solutions. To achieve the best ionization efficiency, the samples can be in the following ratios: cytochrome c (Cyt c):sinapinic acid (SA)=1:1000, BSA:SA=1:2000, immunoglobulin G (IgG):SA=1:100000. For the secretory immunoglobulin A (sIgA) sample, the molar ratio to the matrix (SA) can be 1:200000. After the sample solution is mixed, it may be air-dried on the sample probe.

Mass spectra can be generated by the method of mass selective instability with boundary ejection. In the trapping process, the RF and amplitude can be held constant at, for example, 170 kHz and 650 Vpp (voltage between the rod to ground), respectively. This example setting corresponds to a low-mass cutoff at 5400 Da, and then the RF can be swept to 70 kHz corresponding to 32,200 Da. The pressure of the buffer gas inside the linear ion trap can be maintained at ~20 mTorr during the experiment. The ions can be accumulated in the trap by laser shots, for example 10 laser shots, with the laser fluence at ~1.3 mJ/mm. Since the relationship between frequency and m/z is a square function, the scan rate would not be linear by frequency scanning. The data were then collected with a scan rate of $1\times10^6$ Hz/s.

In some embodiments, a linear ion trap mass spectrometer of this invention can be used for obtaining a mass spectrum of biomolecular ions. The linear ion trap mass spectrometer can include a two dimensional linear ion trap for trapping and ejecting the ions comprising two slotted x electrode rods and two y electrode rods in a quadrupole arrangement. The linear ion trap mass spectrometer can include two power amplifiers to apply opposite phases of the RF to the x and y electrodes, wherein each power amplifier is tuned with a capacitance to provide the same amplitude of RF and a fixed degree of phase difference of the RF to the x and y electrodes during the RF frequency scan; and wherein the ions have very high m/z (Da/q). The linear ion trap mass spectrometer can include an inductance forming an LC circuit with the capacitance of the ion trap, and a first end cap plate perpendicular to the electrode rods at a first end of the linear ion trap and a second end cap plate perpendicular to the electrode rods at a second end of the linear ion trap, wherein the first end cap defines an opening for a sample probe, and wherein the second end cap defines an opening for a laser beam. The linear ion trap mass spectrometer can include a charge detector. These arrangements of the apparatus can provide a linear ion trap mass spectrometer that can be used for obtaining a mass spectrum of biomolecular ions, wherein detection of surprisingly high m/z (Da/q) can be achieved with advantageously low electrical current in the linear ion trap. In some embodiments, the electrical currents in the linear ion trap are less than 20 amperes, or less than 10 amperes, or less than 5 amperes, or less than 2 amperes.

In some aspects, an apparatus having a Faraday cup charge detector and utilizing phase matching and synchronization of four quadrupole rods, so that frequency scan can be performed, makes it possible to obtain signal at very high m/z (Da/q).

By comparison to a conventional linear ion trap, the range of mass-to-charge ratio that can be detected can be greatly extended by the frequency scan apparatus and methods of this invention to ultra high m/z (Da/q).

In some embodiments, a linear ion trap mass spectrometer of this invention can be used for obtaining a mass spectrum of biomolecular ions, wherein detection of surprisingly high m/z (Da/q) can be achieved.

In some embodiments, the detection of m/z (Da/q) up to 400,000, up to 800,000, up to 1,200,000, up to 1,600,000, and up to 2,000,000 can be achieved.

In some embodiments, the detection of m/z (Da/q) can be extended from 10,000 to 1,000,000, or from 10,000 to 2,000,000, or from 100,000 to 2,000,000, or from 400,000 to 2,000,000, or from 400,000 to 1,600,000.

In some embodiments, the detection of m/z (Da/q) can be extended from 300,000 to 10,000,000, or from 400,000 to 20,000,000, or from 400,000 to 2,400,000.

In certain embodiments, the detection of m/z (Da/q) that can be achieved is at least 400,000, at least 800,000, or at least 1,200,000, or at least 1,600,000, or at least 82,000,000.

In further embodiments, the detection of m/z (Da/q) can be extended from 10,000 to 10,000,000, or from 10,000 to 100,000,000.

In additional embodiments, the detection of m/z (Da/q) can be extended from 10,000 to 5,000,000, or from 10,000 to 20,000,000.

In certain embodiments, the range of mass detection can be extended up to $1\times10^{11}$ Da (1E11 Da) with the apparatus and methods of this invention.

In certain embodiments, the range of mass detection can be extended up to $1\times10^{12}$ Da (1E12 Da) with the apparatus and methods of this invention.

In certain embodiments, the range of mass detection can be extended up to $1\times10^{13}$ Da (1E13 Da) with the apparatus and methods of this invention.

In certain embodiments, the range of mass detection can be extended up to $1\times10^{14}$ Da (1E14 Da) with the apparatus and methods of this invention.

In certain embodiments, the range of mass detection can be extended up to $1\times10^{15}$ Da (1E15 Da) with the apparatus and methods of this invention.

In certain embodiments, the range of mass detection can be extended up to $1\times10^{16}$ Da (1E16 Da) with the apparatus and methods of this invention.

In certain embodiments, this invention can provide detection of an unexpectedly advantageous ultra high mass-to-charge ratio, while achieving sensitivity of a few femtomoles (fmol) of sample. In some embodiments, the detection of m/z (Da/q) that can be achieved is at least 400,000, with sensitivity of 2 femtomoles or less of sample. In certain embodiments, the detection of m/z (Da/q) that can be achieved is at least 400,000, with sensitivity of 50 femtomoles or less of sample.

In certain embodiments, this invention can provide detection of an unexpectedly advantageous ultra high mass-to-charge ratio, while achieving sensitivity of a few femtomoles (fmol) of sample. In some embodiments, the detection of m/z (Da/q) that can be achieved is at least 800,000, with sensitivity of 2 femtomoles or less of sample. In certain embodiments, the detection of m/z (Da/q) that can be achieved is at least 800,000, with sensitivity of 50 femtomoles or less of sample.

In certain embodiments, this invention can provide detection of an unexpectedly advantageous ultra high mass, while achieving sensitivity of a few femtomoles (fmol) of sample. In some embodiments, the detection of mass up to $1\times10^{14}$ Da (1E14 Da), with sensitivity of 2 femtomoles or less of sample can be achieved. In certain embodiments, the detection of mass up to $1\times10^{14}$ Da (1E14 Da), with sensitivity of 50 femtomoles or less of sample can be achieved.

In certain embodiments, this invention can provide detection of an unexpectedly advantageous ultra high mass, while achieving sensitivity of a few femtomoles (fmol) of sample. In some embodiments, the detection of mass up to $1\times10^{16}$ Da (1E16 Da), with sensitivity of 2 femtomoles or less of sample can be achieved. In certain embodiments, the detection of mass up to $1\times10^{16}$ Da (1E16 Da), with sensitivity of 50 femtomoles or less of sample can be achieved.

In further embodiments, the detection of ions of mass from $1\times10^{8}$ Da (1E8 Da) to $1\times10^{14}$ Da (1E14 Da) can be achieved.

In further embodiments, the detection of ions of mass from $1\times10^{8}$ Da (1E8 Da) to $1\times10^{16}$ Da (1E16 Da) can be achieved.

In further embodiments, the detection of ions of mass from $1\times10^{14}$ Da (1E14 Da) to $1\times10^{16}$ Da (1E16 Da) can be achieved.

In further embodiments, the detection of ions of mass from $1\times10^{12}$ Da (1E12 Da) to $1\times10^{16}$ Da (1E16 Da) can be achieved.

Example 1

Figure 3:
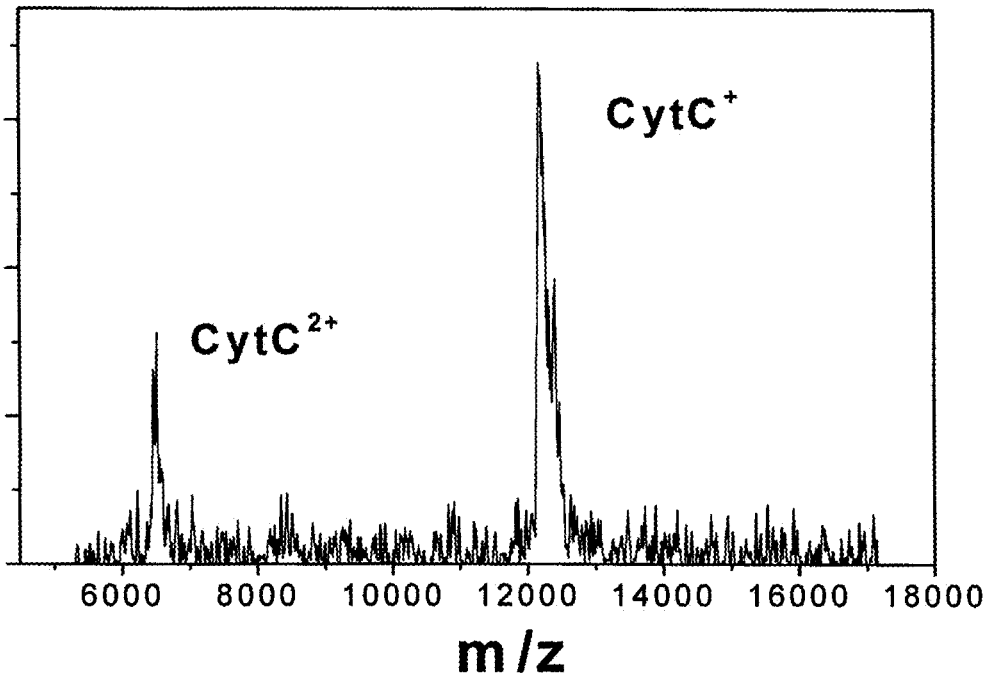
FIG. 3 shows a frequency scan MALDI-LIT mass spectrum of Cytochrome C, MW 12,360.

The frequency scan MALDI-LIT mass spectrum of Cytochrome C, MW 12,360, is shown in FIG. 3. An RF of 170 kHz was employed as the trapping frequency at 650 $V_{p\text{-}p}$. After that, the frequency scanning process was carried out from 170 kHz to 70 kHz during 100 ms. The mass spectrum was collected with an oscilloscope. As shown in FIG. 3, the spectrum contained two distinctive peaks. The feature at m/z of about 12,360 was assigned to a singly charged Cytochrome C ion, and the feature at m/z of about 6,180 was assigned to a doubly charged Cytochrome C ion.

Figure 4:
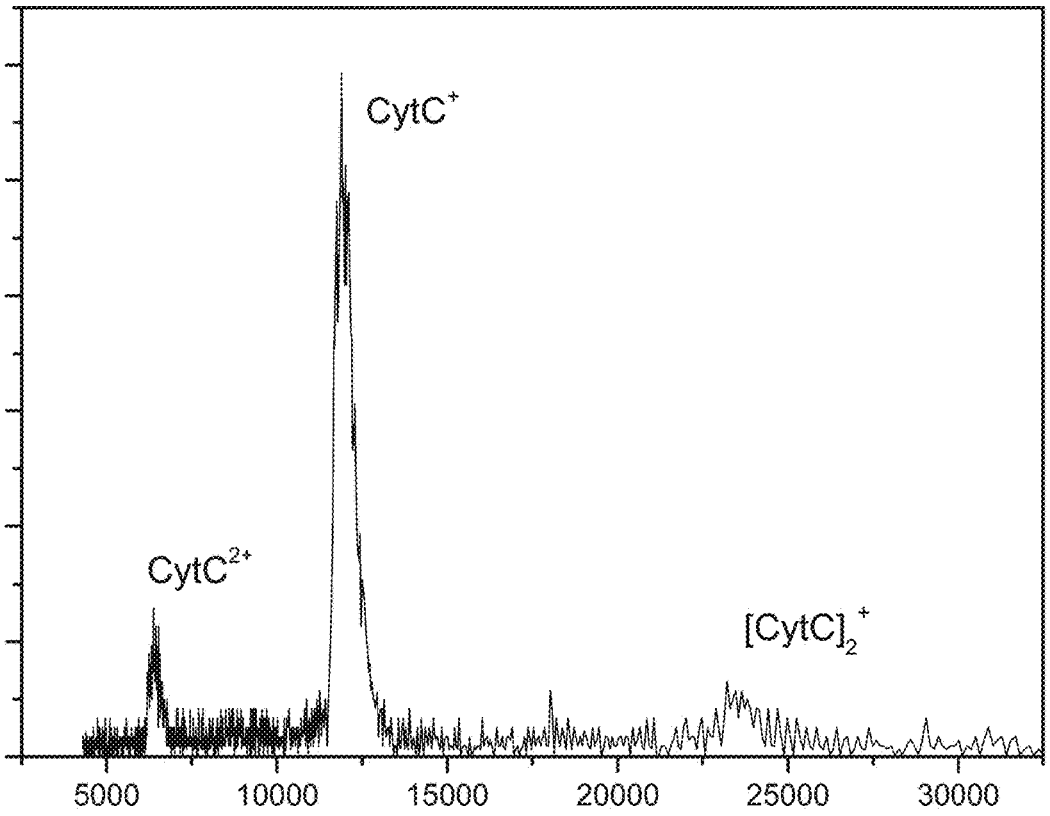
FIG. 4 shows a frequency scan MALDI-LIT mass spectrum of Cytochrome C, MW 12,360, showing the signals of $CytC^{2+}$ and $[CytC]_2^{+}$.

FIG. 4 shows a frequency scan MALDI-LIT mass spectrum of Cytochrome C, MW 12,360, showing the signals of $CytC^{2+}$ and $[CytC]_2^{+}$.

To confirm mass accuracy in the m/z region greater than 10,000, the laser power of MALDI was increased to obtain spectra for cytochrome c ions with different mass-to-charge ratios. FIG. 4 shows the mass spectrum of cytochrome c with the laser fluence at 2 mJ/mm$^2$. The spectrum includes a peak of singly charged Cyt c ion, and two minor peaks from doubly charged Cyt c ion, and a singly charged ion of the Cyt c dimer, respectively. The peaks shown in FIG. 4 indicate the correct readings of the corresponding m/z. Therefore, this spectrum confirms the mass accuracy in this m/z region (>10 000) for the frequency-scanned linear ion trap mass spectrometer.

Figure 5:
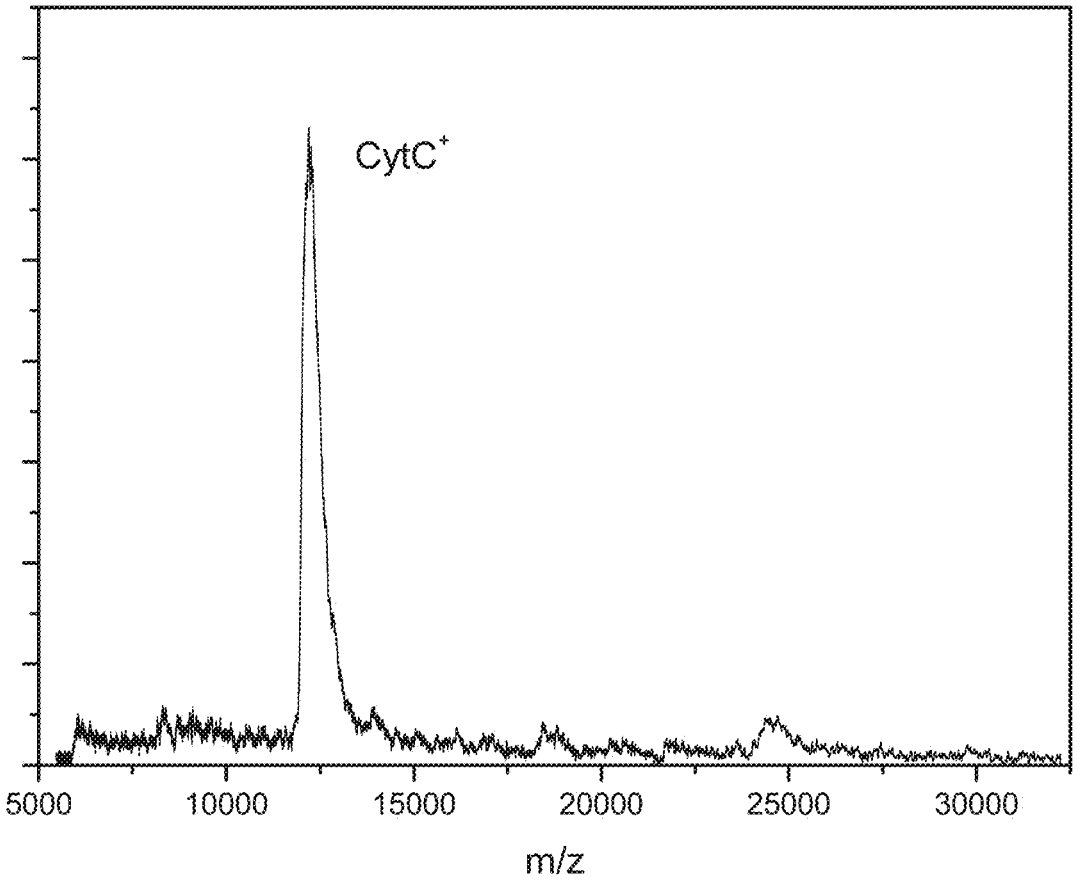
FIG. 5 shows a frequency scan MALDI-LIT mass spectrum of Cytochrome C, MW 12,360, with scan up to 30,000 m/z.

FIG. 5 shows a frequency scan MALDI-LIT mass spectrum of Cytochrome C, MW 12,360, with scan up to 30,000 m/z. The amount of sample consumed was estimated as ~250 fmol.

Example 2

Figure 6:
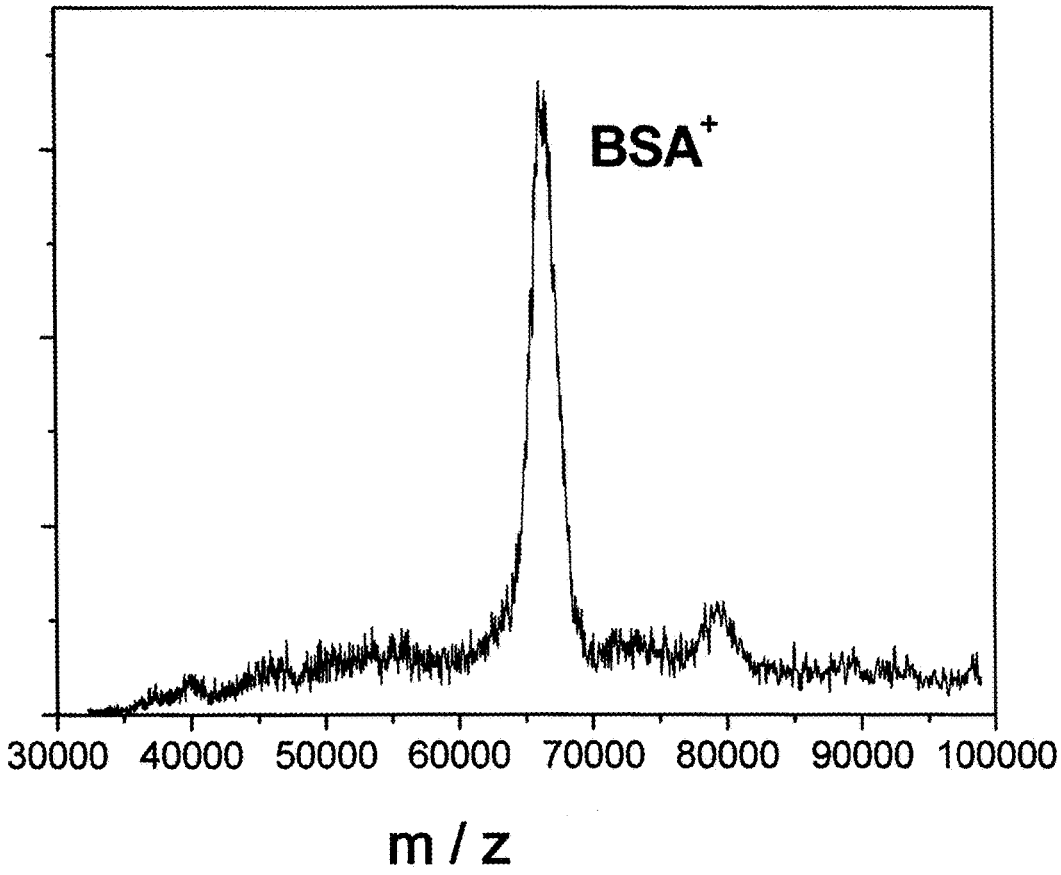
FIG. 6 shows a frequency scan MALDI-LIT mass spectrum of BSA, MW 66,000.

The frequency scan MALDI-LIT mass spectrum of BSA, MW 66,000, is shown in FIG. 6. The trapping frequency was 70 kHz, and the stationary amplitude of RF was 650 volt. The frequency scanning process was carried out from 70 kHz to 40 kHz through 100 ms sweeping time.

Figure 7:
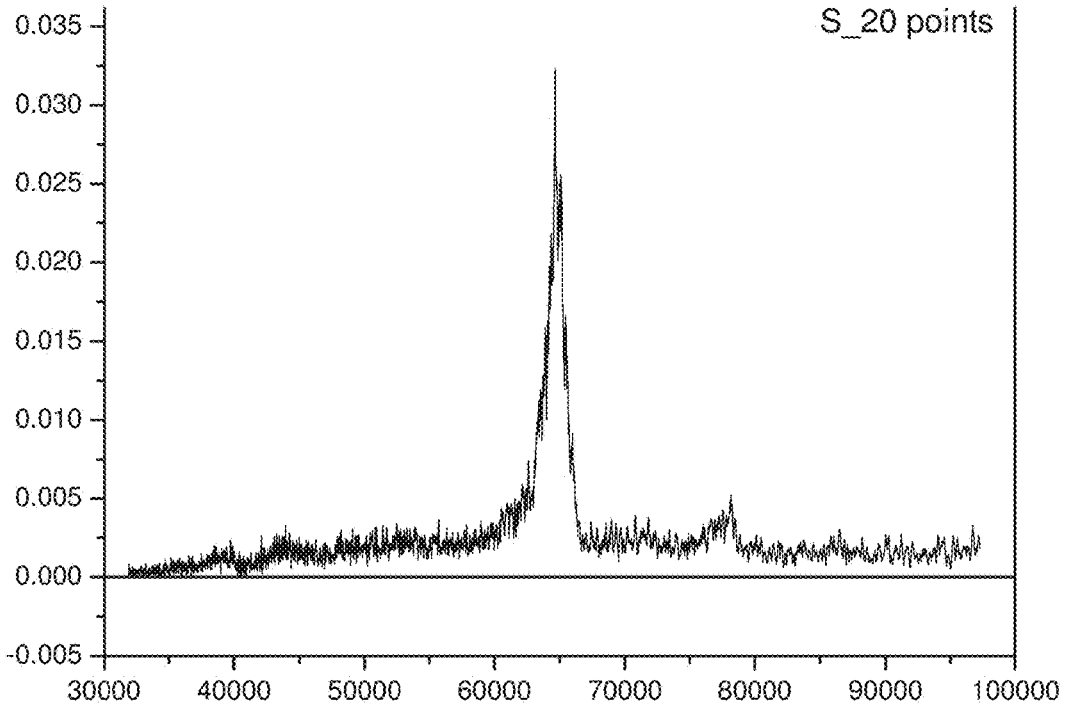
FIG. 7 shows a frequency scan MALDI-LIT mass spectrum of BSA, MW 66,000, with scan up to 100,000 m/z.

FIG. 7 shows a frequency scan MALDI-LIT mass spectrum of BSA, MW 66,000, with scan up to 100,000 m/z. This example shows an extended m/z region. A trapping RF was applied at 70 kHz, and ramped to 40 kHz, corresponding to m/z at 97,300. The RF amplitude was held constant at 640 V during the scanning process. BSA was selected as a test sample in this detection region. The frequency scan rate was $3\times10^{5}$ Hz/s. The spectrum was obtained with the accumulation of 20 laser shots with the fluence at ~1.3 mJ/mm. The sample consumed was estimated as about 400 fmol. To increase the trapping efficiency, 30 mTorr of He was maintained as the buffer gas to reduce the kinetic energy of BSA ions. In this result, the signal of singly charged BSA with m/z at 66,000 was clearly observed.

Example 3

Figure 8:
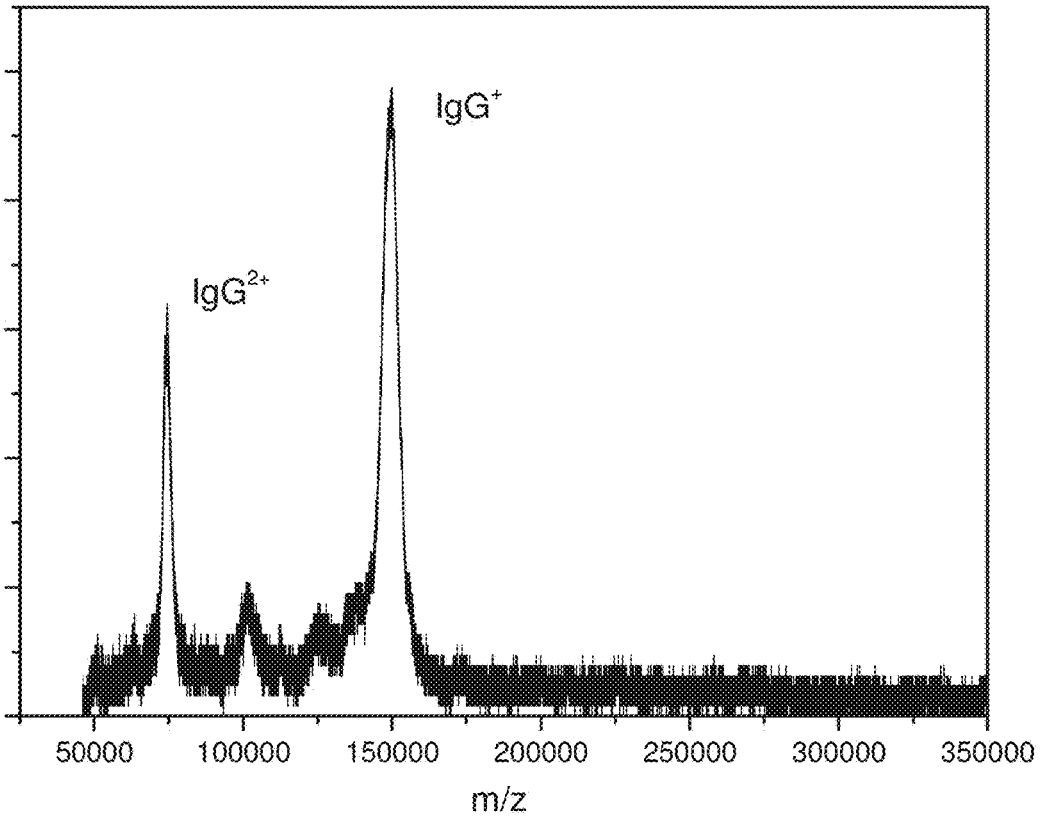
FIG. 8 shows a frequency scan MALDI-LIT mass spectrum of IgG, a 150 kDa protein, with scan up to 350,000 m/z.

FIG. 8 shows a frequency scan MALDI-LIT mass spectrum of IgG, a 150 kDa protein, with scan up to 350,000 m/z.

The spectrum in FIG. 8 was collected by sweeping the RF from 60 to 20 kHz at a stationary amplitude of 635 V. The scan region of m/z began from 46,000 to 414,230 with a $4\times10^{5}$ Hz/s scanning rate.

In FIG. 8, there are two clear peaks observed. The major peak is singly charged IgG with m/z at ~150 000, and the minor peak is assigned to doubly charged IgG at ~75 000 m/z. The laser fluence was at 2 mJ/mm$^2$, and the ratio of matrix to analyte was also increased to 100,000. To obtain enough trapping efficiency, the He buffer gas was increased to 60 mTorr to reduce the kinetic energy from the high molecular weight. It was noticeable that the pressure of buffer gas needed was much larger than that for low m/z. The signal of IgG was not observed when the pressure was set lower than 50 mTorr. Since the larger ions produced by MALDI have higher kinetic energy during the desorption process, more buffer gas was employed to quench the kinetic energy. To improve the detection efficiency, the voltage of the conversion dynode was increased to −25 kV, which was higher than that for the detection of cytocrome c and BSA (−15 kV). The spectrum was accumulated with 20 shots of laser. The sample consumed was estimated as 50 fmol.

Figure 9:
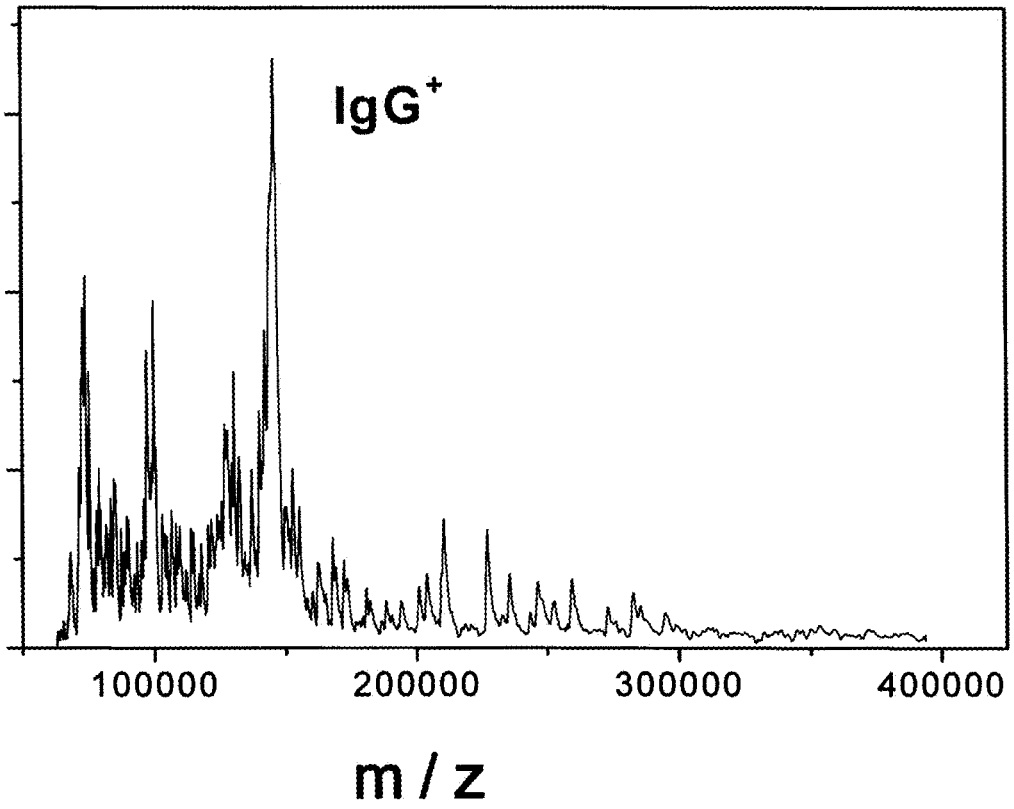
FIG. 9 shows a frequency scan MALDI-LIT mass spectrum of IgG, a 150 kDa protein, with scan up to 400,000 m/z.

A frequency scan MALDI-LIT mass spectrum of IgG, a 150 kDa protein, is shown in FIG. 9. This mass spectrum was collected by scanning the RF from 80 kHz to 20 kHz. During the 100 ms sweeping time, the stationary amplitude of RF was also 650 volt. This frequency scan MALDI-LIT mass spectrum demonstrated that the methods of this invention can be used to extend the range of observed mass-to-charge ratios to values as much as twenty-five times greater than without the frequency scanning methods.

A frequency scan method can be used for a linear ion trap. For tuning a specific resonant frequency, the ion trap may be coupled with a variable capacitor. The capacitance of the variable capacitor can be controlled to vary the resonance frequency of the RLC circuit. When the value of the inductor is fixed, the capacitance of the variable capacitor can be used to obtain a specific resonant frequency in a stepwise scan.

In some embodiments, the value of a variable capacitor can be from 50-100 pF in a tuning box of the high voltage probe. The high voltage probe can be used to measure the high voltage of the RF, and to modulate or attenuate the amplitude of the RF to balance X and Y voltages. The amplitude of the RF can be fine-tuned using the series connection of the variable capacitor, and the variable capacitor can be used for compensation of the RF voltage as the frequency changes in frequency sweeping.

In additional aspects, this invention may provide a mass spectrometer apparatus and methods capable of detecting biomolecules such as proteins, antibodies, protein complexes, protein conjugates, nucleic acids, oligonucleotides, DNA, RNA, polysaccharides and many others with high detection efficiency and resolution.

Example 4

Figure 10:
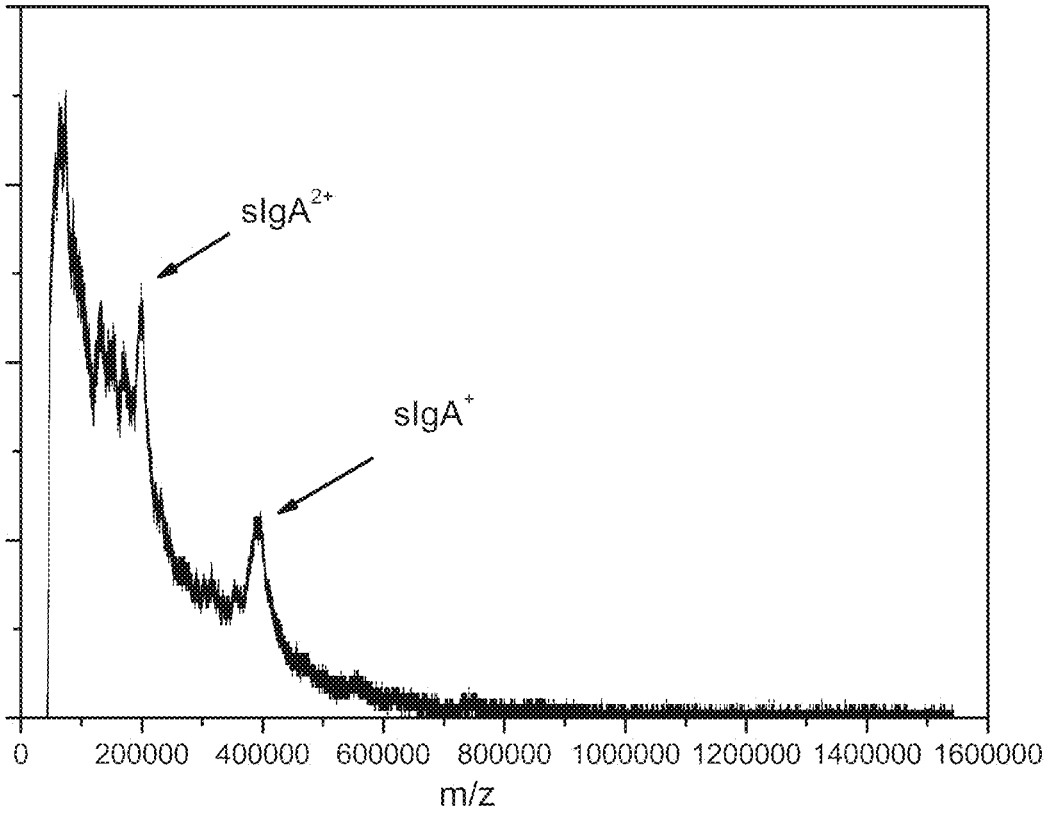
FIG. 10 shows a frequency scan MALDI-LIT mass spectrum of sIgA, a 385 kDa protein, with scan up to 1,600,000 m/z.

FIG. 10 shows a frequency scan MALDI-LIT mass spectrum of sIgA, a 385 kDa protein, with scan up to 1,600,000 m/z.

MALDI-LIT was used to measure secretory sIgA, a protein with molecular mass ~385 kDa. The spectrum shown in FIG. 10 was collected by sweeping the RF from 60 to 10 kHz at a stationary amplitude of 635 V. The scan covered the region from 46,000 to 1,543,000 for m/z with a scanning rate at $50\times10^5$ Hz/s. The singly and doubly charged sIgA ions were assigned in FIG. 10.

The background for m/z between 50,000 and 700,000 can be due to the cluster ion of matrix molecules since high pressure and high laser power were employed in this spectrum. The laser power was increased to 3 $mJ/mm^2$, and the He buffer gas was maintained at 60 mTorr. The voltage of the conversion dynode was increased to ~30 kV to produce more secondary electrons. The spectrum was obtained with the accumulation of signals from 20 shots of laser. The sample consumed was estimated as ~2 fmol. Compared to that of a conventional LIT mass analyzer, the m/z range was dramatically increased in this result. Ions with even higher m/z can be measured by decreasing the RF.

In some embodiments, the methods of this invention may be used to obtain the mass spectra of nanoparticles, viruses, and other biological components and organelles having sizes in the range of up to about 50 nanometers or greater.

In some variations, the apparatus and methods of this disclosure can also provide mass spectra of small molecule ions.

Examples of methods for ionization in mass spectrometry include laser ionization, MALDI, electrospray ionization, thermospray ionization, thermal ionization, electron ionization, chemical ionization, inductively coupled plasma ionization, glow discharge ionization, field desorption ionization, fast atom bombardment ionization, spark ionization, or ion attachment ionization.

Example 5

Feedback control and balanced frequency sweeping.

Figure 11:
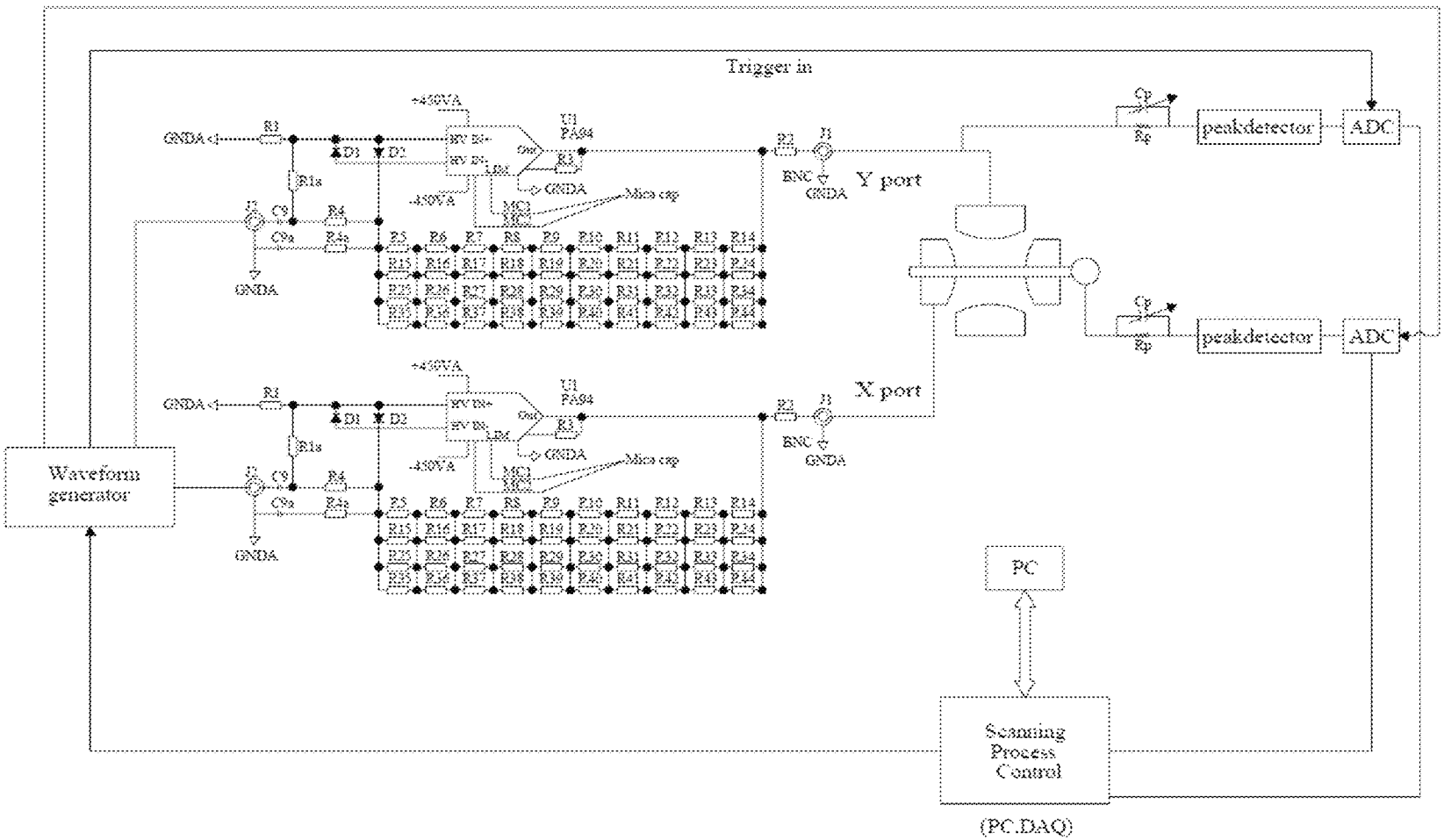
FIG. 11 shows an embodiment of a circuit for the RF balancing of the linear ion trap by accurate and electronic adjustment of variable capacitors within the high voltage probe.
Figure 12:
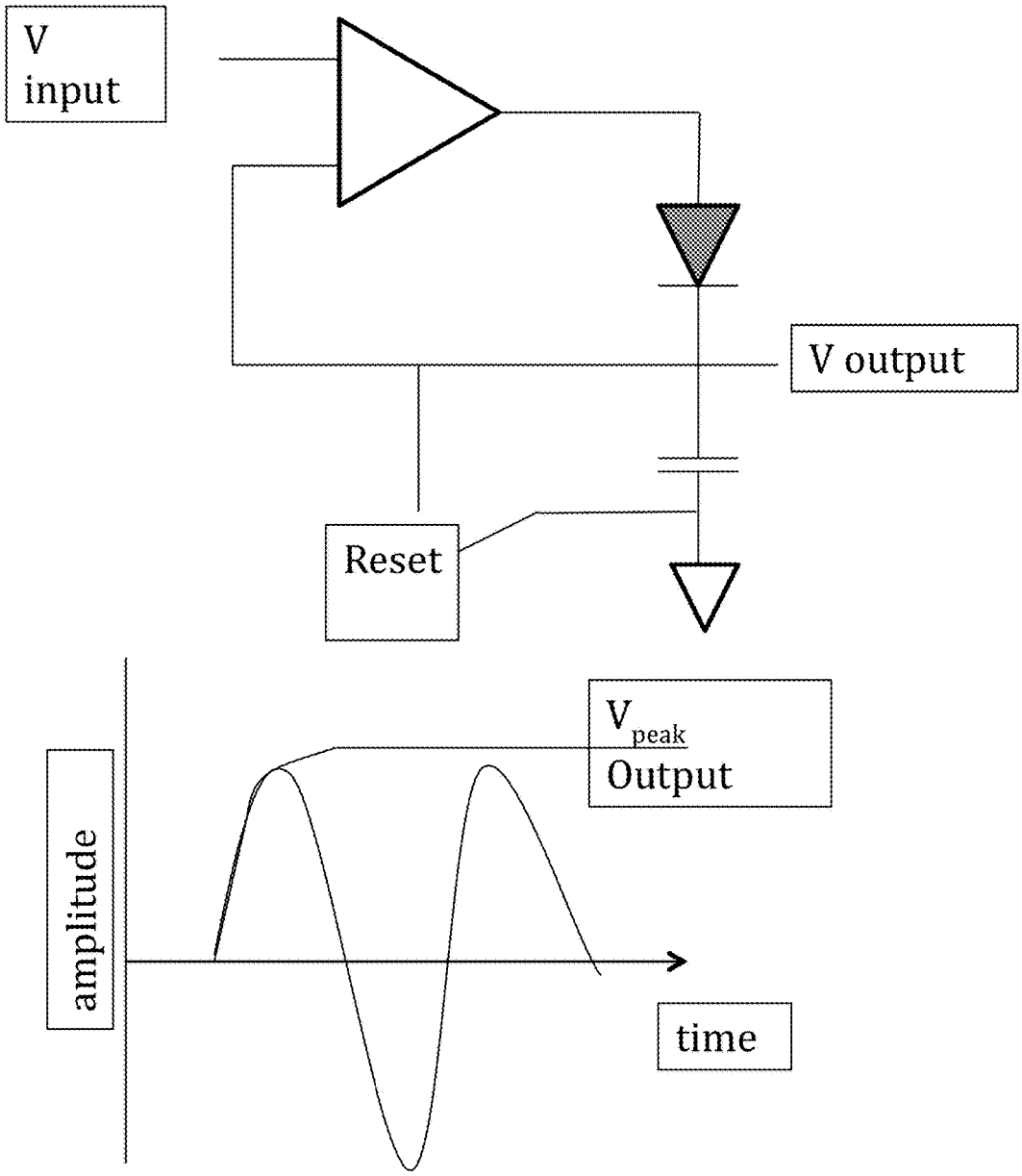
FIG. 12 shows an embodiment of a voltage peak detector, showing an output DC voltage with respect to an RF voltage.

In some embodiments, the RF balancing of the linear ion trap can be achieved by accurate and electronic adjustment of variable capacitors of the high voltage probe. Such feedback control was achieved with a high voltage peak detector, followed by adjusting the amplitude of an arbitrary function generator. An example of the circuit is shown in FIG. 11. The output DC voltage of the voltage peak detector can be made equal to the peak of the applied RF, and therefore can be used to adjust the variable capacitors of the high voltage probe. An example of the output DC voltage of the voltage peak detector is shown in FIG. 12.

Balancing of the RF voltage can be achieved by fine-tuning two variable capacitors ($C_p$) of the high voltage probe.

The high voltage peak detector can detect the peak value of the high voltage AC signals of the X and Y electrodes, and consequently output a DC signal to an analog to digital convertor.

In operation, upon detecting a decrease of the high voltage RF signal, a processor or computer can be used to control an arbitrary function generator to increase the amplitude of the signal from the arbitrary function generator to balance the output of the high voltage RF signals of the X and Y electrodes during a stepwise frequency sweep.

In general, in some embodiments, the frequency sweep speed can be too fast to execute real time feedback control. This problem can be solved by pre-scanning, so that the variation of the high RF voltage can be detected using a low speed stepwise sweep scan (pre-scanning). Thereby, the compensation signal of an arbitrary function generator can be obtained to balance the output of the high voltage RF signals of the X and Y electrodes during a stepwise frequency sweep. This apparatus and method can be used to perform RF balancing of the X and Y electrodes during data acquisition.

Unless defined otherwise, all technical and scientific terms used herein have the same meanings as commonly understood by one of ordinary skill in the art to which this invention belongs. Although any methods and materials similar or equivalent to those described herein can be used in the practice or testing of the present invention, the preferred methods and materials are described herein.

All publications and patents and literature specifically mentioned herein are incorporated by reference for all purposes. Nothing herein is to be construed as an admission that the invention is not entitled to antedate such disclosure by virtue of prior invention.

It is understood that this invention is not limited to the particular methodology, protocols, materials, and reagents described, as these may vary. It is also to be understood that the terminology used herein is for the purpose of describing particular embodiments only, and is not intended to limit the scope of the present invention which will be encompassed by the appended claims.

It must be noted that as used herein and in the appended claims, the singular forms "a", "an", and "the" include plural reference unless the context clearly dictates otherwise. As well, the terms "a" (or "an"), "one or more" and "at least one" can be used interchangeably herein. It is also to be noted that the terms "comprises," "comprising", "containing," "including", and "having" can be used interchangeably.

Without further elaboration, it is believed that one skilled in the art can, based on the above description, utilize the present invention to its fullest extent. The following specific embodiments are, therefore, to be construed as merely illustrative, and not limitative of the remainder of the disclosure in any way whatsoever.

All of the features disclosed in this specification may be combined in any combination. Each feature disclosed in this specification may be replaced by an alternative feature serving the same, equivalent, or similar purpose.

What is claimed is:

1. A method for obtaining a mass spectrum of biomolecular ions, the method comprising:

providing a two dimensional linear ion trap comprising x and y electrodes, wherein the x and y electrodes are consisting of two x electrode rods and two y electrode rods in a quadrupole arrangement, wherein the two dimensional linear ion trap is non-segmented and is the only ion trap used, and wherein the linear ion trap comprises two end plates perpendicular to the rods to confine or release ions in the z axial direction with an axial trapping field;

scanning an RF frequency stepwise, with fixed amplitude applied to the linear ion trap for ion trapping and mass selective ejection of the ions, wherein the phase of the scanning RF and trapping RF are matched, wherein the RF phases are also matched to the timing of laser shots which generate the ions, and wherein the two x and two y quadrupole rods are synchronized using two power amplifiers to apply opposite phases of the RF to the x and y electrodes, wherein each power amplifier is tuned with a capacitance to provide the same amplitude of RF as the other amplifier and a fixed degree of phase difference of the RF to the x and y electrodes during the RF frequency scan;

detecting the biomolecular ions ejected from the linear ion trap using a charge detector, wherein the ions have an m/z of at least 150,000 Da/q.

2. The method of claim 1, wherein the mass selective ejection of the ions is generated by mass selective instability with or without resonance excitation by boundary ejection.

3. The method of claim 1, wherein the ejection of the ions is axial or perpendicular.

4. The method of claim 1, wherein the ejection of the ions is through a slot in an electrode.

5. The method of claim 1, wherein the linear ion trap has end plate electrodes that are perpendicular to the rods and spaced apart from each end of the rods, and wherein a fixed voltage of from +5 to +200 V is applied to the end plates.

6. The method of claim 1, wherein the linear ion trap contains a buffer gas of helium or other rare gas at a pressure of from 1 to 500 mTorr.

7. The method of claim 1, wherein the ions are generated by MALDI, electrospray ionization, laser ionization, thermospray ionization, thermal ionization, electron ionization, chemical ionization, inductively coupled plasma ionization, glow discharge ionization, field desorption ionization, fast atom bombardment ionization, spark ionization, or ion attachment ionization.

8. A linear ion trap mass spectrometer for obtaining a mass spectrum of biomolecular ions, the linear ion trap mass spectrometer comprising:

a single, non-segmented two dimensional linear ion trap for trapping and ejecting the ions having x and y electrodes consisting of two slotted x electrode rods and two y electrode rods in a quadrupole arrangement, and wherein the two dimensional linear ion trap is the only ion trap used;

two power amplifiers to apply opposite phases of trapping RF to the x and y electrodes, wherein the two power amplifiers synchronize the two x and two y quadrupole rods, wherein each power amplifier is tuned with a capacitance to provide the same amplitude of RF as the other amplifier and a fixed degree of phase difference of the RF to the x and y electrodes during a stepwise, RF frequency scan with fixed amplitude; wherein the phase of the scanning RF and trapping RF are matched, wherein the RF phases are also matched to the timing of laser shots which generate the ions, and wherein the ions have an m/z of at least 150,000 Da/q;

an inductance forming an LC circuit with the capacitance of the ion trap;

a first end cap plate perpendicular to the electrode rods at a first end of the linear ion trap and a second end cap plate perpendicular to the electrode rods at a second end of the linear ion trap, wherein the first end cap defines an opening for a sample probe, and wherein the second end cap defines an opening for exit of ions and for passing a laser beam, wherein the end plates confine or release ions in the z axial direction with an axial trapping field.

9. The linear ion trap mass spectrometer of claim 8, wherein the end plates are spaced apart by 1 to 10 mm from the ends of the electrode rods.

10. The linear ion trap mass spectrometer of claim 8, further comprising a buffer gas within the linear ion trap.

11. The linear ion trap mass spectrometer of claim 10, wherein the buffer gas is helium or other rare gas at a pressure of from 1 to 500 mTorr.

12. The ion trap mass spectrometer of claim 8, wherein the ions are generated by MALDI, electrospray ionization, laser ionization, thermospray ionization, thermal ionization, electron ionization, chemical ionization, inductively coupled plasma ionization, glow discharge ionization, field desorption ionization, fast atom bombardment ionization, spark ionization, or ion attachment ionization.

* * * * *